US005674362A

United States Patent [19]

Underwood et al.

[11] Patent Number: 5,674,362

[45] Date of Patent: Oct. 7, 1997

[54] METHOD FOR IMPARTING STRENGTH TO PAPER

[75] Inventors: Richard T. Underwood; Robert J. Jasion; Stephen P. Hoke; Gavin G. Spence, all of Columbus, Ga.

[73] Assignee: Callaway Corp., Columbus, Ga.

[21] Appl. No.: 601,296

[22] Filed: Feb. 16, 1996

[51] Int. Cl.[6] ..... D21H 17/45

[52] U.S. Cl. ..... 162/164.3; 162/164.6; 162/168.2; 162/168.3

[58] Field of Search ..... 162/164.3, 164.6, 162/168.3, 183, 168.2

[56] References Cited

U.S. PATENT DOCUMENTS 5,427,652 6/1995 Darlington et al. ..... 162/164.3

*Primary Examiner*—Peter Chin

*Attorney, Agent, or Firm*—Bruce F. Jacobs; Diderico Van Eyl

[57] ABSTRACT

A method for imparting strength to paper by adding to a pulp slurry during a paper-making process a mixed resin solution containing (i) an aminopolyamide-epichlorohydrin resin and (ii) a glyoxylated acrylamide-dimethyl diallyl ammonium chloride resin.

9 Claims, 4 Drawing Sheets

METHOD FOR IMPARTING STRENGTH TO PAPER

FIELD OF THE INVENTION

The present invention is directed to a method for imparting dry strength and wet strength to paper, particularly recycled paper.

BACKGROUND OF THE INVENTION

Additives are typically used during paper-making processes to impart strength to paper. During the stock-preparation step of paper-making processes, for instance, paper-making pulps are most conveniently handled as aqueous slurries, so that they can be conveyed, measured, subjected to desired mechanical treatments, and mixed with nonfibrous additives before being delivered to a paper making machine. During filling and loading stages of paper-making processes, materials such as mineral pigments are added to the pulp slurries. During sizing, materials are added to slurries in order to render the resulting paper sheet more resistant to penetration of liquids. During continuous sheet forming steps of paper-making processes, additives are delivered to fiber slurries at the wet end of paper machines.

Glyoxylated polyacrylamide-diallyldimethyl ammonium chloride copolymer (GPA) resins are known for use as dry strength and temporary wet strength resins for paper. U.S. Pat. No. 4,605,702, for instance, teaches the preparation of a wet strength additive by glyoxalating an acrylamide copolymer having a molecular weight from about 500 to 6000. The resulting resins have limited stability in aqueous solution and gel after short storage periods even at non-elevated temperatures. Accordingly, the resins are typically supplied in the form of relatively dilute aqueous solutions containing only about 5–10 wt % resin.

Aminopolyamide-epichlorohydrin (APAE) resins have been used as wet strength additives for paper. U.S. Pat. No. 3,311,594, discloses the preparation of APAE wet strength resins. The resins are prepared by reacting epichlorohydrin with aminopolyamides, sometimes referred to as polyaminoamides, or polyaminourylenes containing secondary amino hydrogens. The APAE resins can also exhibit storage problems in concentrated form and gel during storage, although generally to a lesser extent than the GPA resins. As such, it has been common practice to dilute the APAE resins to low solids levels to minimize gelation. The APAE resins also impart dry strength to paper, but the vast increase in wet strength which results simultaneously has made APAE resins unsuitable for use in the preparation of recyclable paper.

It has been found unexpectedly that paper having improved strength can be obtained in recycled paper by mixing the APAE resin and the GPA resin and then adding the mixed resin solution to the wet end of the paper-making process. The mixed resin solution has been found to produce paper which exhibits significantly increased dry strength performance as compared to the joint use of the resins individually. It has also been unexpectedly found that the mixed resin solution functions as a wet strength additive at any point in the paper-making process where wet strength additives are customarily added without unduly increasing the wet strength of the resulting paper. Still furthermore, the mixed resin solution exhibits enhanced stability as compared to the individual resin solutions as disclosed in co-filed U.S. application Ser. No. (Attorney Docket CCC-95-06).

It is an object of this invention to develop a method for imparting dry strength to the recyclable paper.

It is a further object of this invention to develop a method for improving the dry strength of recycled paper without simultaneously unduly increasing the wet strength thereof.

It is a further object of this invention to develop a method for imparting wet strength to the recyclable paper.

It is a further object of this invention to develop a method for imparting dry and wet strength to the recyclable paper.

SUMMARY OF THE INVENTION

The present invention is directed to a method for imparting dry and/or wet strength to paper by adding to a recycle pulp slurry during a paper-making process a mixed resin solution comprising (i) an aminopolyamide-epichlorohydrin resin and (ii) a glyoxylated acrylamide-diallyldimethyl ammonium chloride resin.

DESCRIPTION OF THE PREFERRED EMBODIMENTS

Figure 1:
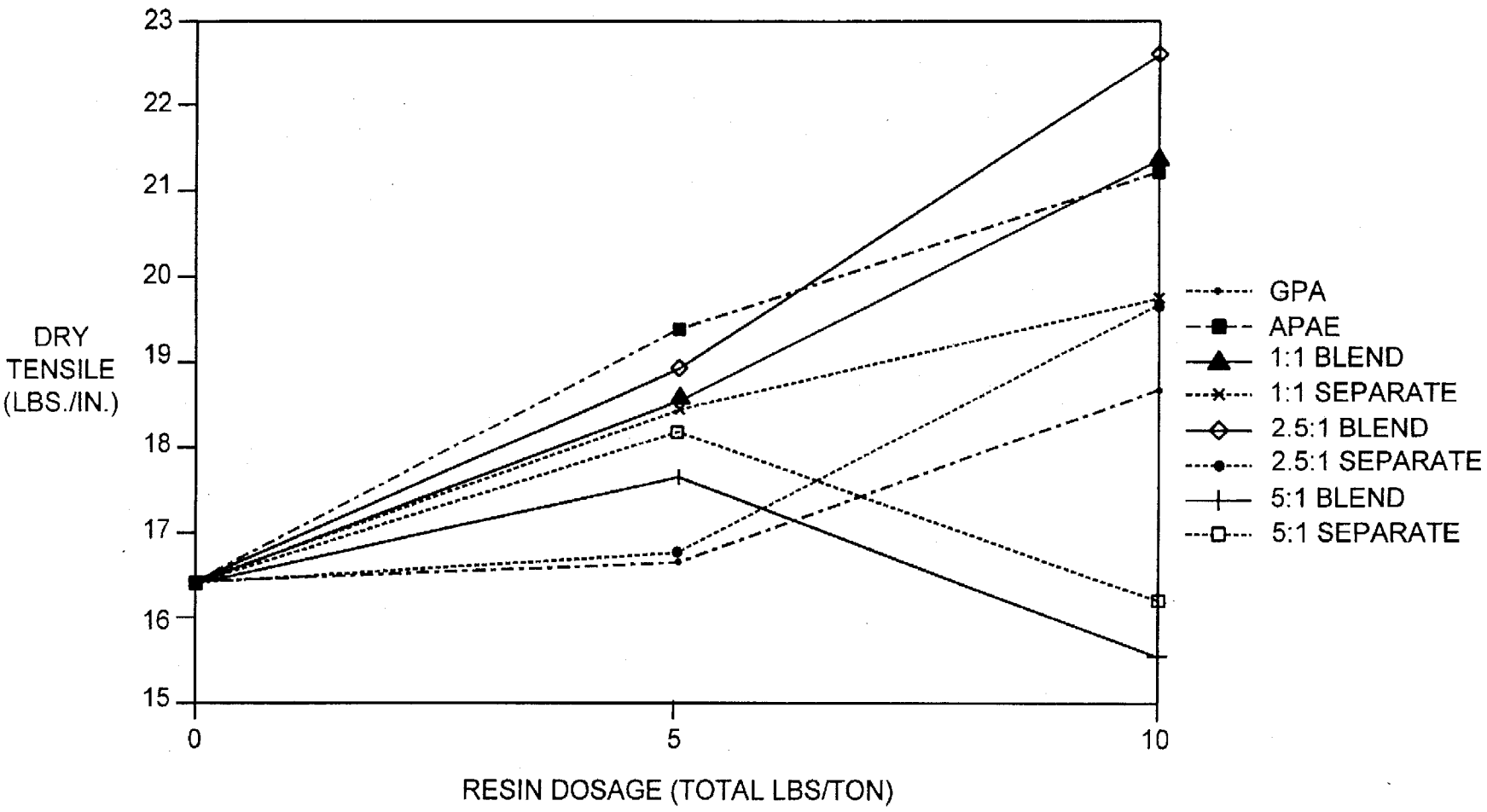
FIG. 1 is a graph showing the dry tensile strength of recycled paper prepared in accordance with this invention using resin solutions having GPA:APAE mole ratios of 1:1, 2.5:1, and 5:1.

The present invention is directed to a method for imparting dry and/or wet strength to paper by adding to a recycle pulp slurry during a paper-making process a mixed resin solution comprising (i) an aminopolyamide-epichlorohydrin resin and ( ii ) a glyoxylated acrylamide-diallyldimethyl ammonium chloride resin. The resin solution functions as a dry strength additive when added to the wet end of a paper machine used to prepare recycled paper. The resin solution also functions as a wet strength additive at any point in the paper-making process where wet strength additives are customarily added without increasing the wet strength of the recycled paper such that it is not readily recyclable.

The APAE resin is prepared by reacting an aminopolyamide and epichlorohydrin in a conventional manner, such as is disclosed in U.S. Pat. Nos. 3,197,427, 3,442,754, and 3,311,594, the subject matter of each patent is incorporated herein by reference. APAE resin solutions have a viscosity of less than about 150 cp for at least 90 days when kept at room temperature as a solution containing about 12.5 wt % resin.

The aminopolyamide is formed by reacting a carboxylic acid with a polyalkylene polyamine under conditions which produce a water-soluble, long-chain polyamide containing the recurring groups:

$$—NH(C_nH_{2n}HN)_x—CORCO—$$

wherein n and x are each 2 or more and R is the divalent, organic radical of the dicarboxylic acid. Dicarboxylic acids useful in preparing the aminopolyamide include saturated aliphatic dicarboxylic acids, preferably containing from about 3 to 8 carbon atoms, such as malonic, succinic, glutaric, adipic, and so on, together with diglycolic acid. Of these, diglycolic acid and the saturated aliphatic dicarboxylic acids having from about 4 to 6 carbon atoms in the molecule, namely, succinic, glutaric, and adipic acids are the most preferred. Blends of two or more dicarboxylic acids may be used, as well as blends which include higher saturated aliphatic dicarboxylic acids such as azelaic and sebatic, as long as the resulting long-chain polyamide is water soluble or at least water dispersible.

Useful polyamines include polyalkylene polyamines such as polyethylene polyamines, polypropylene polyamines, polyoxybutylene polyamines. More specifically, the polyalkylene polyamines of this invention are polyamines containing two primary amine groups and at least one secondary amine group in which the nitrogen atoms are linked together by groups of the formula $—C_nH_{2n}—$ where n is a small integer greater than about 1, and the number of such groups in the molecule ranges from up to about eight, preferably about four. The nitrogen atoms may be attached to adjacent carbon atoms in the $—C_nH_{2n}—$ group or to carbon atoms further apart, but not to the same carbon atom. Specific polyamines include but are not limited to diethylenetriamine, triethylenetetramine, tetraethylenepentamine, dipropylenetriamine, and the like. Suitable polyamines for use in this invention also include mixtures and various crude polyamine materials, such as the polyamine mixture obtained by reacting ammonia and ethylene dichloride.

A preferred method for preparing the APAE resin entails reacting an aminopolyamide with epichlorohydrin in a mole ratio of epichlorohydrin to free amino groups of about 0.5:1.8, and more preferably 0.5:1.5 in aqueous solution, and more preferably 1:1.25. The temperature may vary from about 45° C. to about 100° C. Suitable APAE resins are commercially available and may be obtained from several sources including Callaway Chemical Company, Columbus, Ga. under the trade name Discostrength® 5800.

The GPA resin is prepared by first copolymerizing an acrylamide monomer with diallyldimethyl ammonium chloride (DADMAC) in aqueous solution, and then reacting the resulting copolymer with glyoxal, such as is disclosed in U.S. Pat. Nos. 3,556,932, and 4,605,702. Although not presently preferred, other copolymers may be used: methacryloyloxyethyl trimethyl ammonium methyl sulfate, methacryloyloxyethyl trimethyl ammonium chloride, acryloyloxyethyl trimethyl ammonium methyl sulfate, acryloyloxyethyl trimethyl ammonium chloride, acrylamidopropyl trimethyl ammonium chloride. The subject matter of each patent is incorporated herein by reference.

A resin solution of GPA generally has a viscosity of less than about 150 cp and does not gel for at least 14 days when kept at room temperature as a solution containing 8 wt % resin.

Suitable acrylamide monomers for use herein may be any acrylamide, such as acrylamide per se, methacrylamide and the like. Moreover, up to about 10% by weight of the acrylamide comonomers may be replaced by other comonomers copolymerizable with the acrylamide, i.e. acrylic acid, acrylic esters such as ethyl acrylate, methylmethacrylate, acrylonitrile, styrene, vinylbenzene sulfonic acid, and the like. Generally, from about 75 to about 95 wt % acrylamide, and from about 5 to 25 wt % diallyldimethyl ammonium chloride are used.

In copolymerizing the acrylamide with the diallyldimethyl ammonium chloride, free radical generating initiators are generally added to an aqueous monomer solution. The polymerization takes place at a temperature that is generally between about room temperature and about 100° C. The resulting AM-DADMAC copolymer has an equivalent molecular weight that is generally in the range from about 500 to 100,000 daltons, preferably about 35,000 to about 50,000 daltons.

In reacting the resulting acrylamide-DADMAC copolymer and the glyoxal, the mole ratio of the glyoxal to the acrylamide copolymer is preferably between about 2:1 to about 0.5:1, and more preferably about 1:1. The temperatures employed are preferably from about 25° C. to about 100° C., and the pH during the reaction is preferably kept within the range of about 3 to about 10. Suitable GPA resins may be obtained from Callaway Chemical Company, Columbus, Ga. under the trade name Discostrength® 19.

The mixed resin solution of this invention is prepared by combining a GPA resin solution and an APAE resin solution in suitable amounts such that the mixed resin solution provides about a 20 to 50% dry strength increase as compared to paper prepared with no dry strength additive. Furthermore, the mixed resin solution provides from about 10 to about 30% dry strength increase as compared to paper prepared with the same amount of a GPA resin alone. The GPA:APAE weight ratio to achieve such dry and wet strength performance is generally between about 1:1 and about 5:1. Preferably, the GPA:APAE weight ratio is between about 2:1 and 4:1 and more preferably it is between about 2.2:1 and about 2.8:1.

The GPA and APAE resin solutions are mixed until a substantially homogenous final resin solution is produced. The resin solution may contain a higher solids content than is present in commercial GPA or APAE resin solutions, e.g. from about 5 up to about 25 wt % total resin.

It has been found that mixing the resin solutions by means of a stirring blade produces excellent results. The mixing time is generally from about 5 minutes to about 1 hour, but factors such as the GPA:APAE weight ratio, the mixing temperature, and the mixing technique utilized may influence the actual mixing time.

In the present invention, the mixed resin solution is incorporated into a recycle slurry at a dosage rate that will impart the desired dry strength to the paper. Generally, the resin solution is applied at a dosage rate between about 1 lb/ton of pulp slurry to 20 lbs/ton. Preferably, the dosage rate is from about 5 to 15 lbs/ton, and more preferably the dosage rate is from about 8 to 12 lbs/ton. The actual dosage rate, however, may vary according to factors such as the resin concentration of the mixed resin solution, the temperature, and the equipment used.

The mixed resin solution can be effectively applied to preformed paper by the "tub" or impregnation method, but is more conveniently applied directly to the recycle pulp slurry at any point in the paper-making process where dry or wet strength additives are customarily added. The resin solution is thus typically added to the pulp slurry prior to the wet end of a recycled paper machine before the slurry is introduced through a headbox and slice, and before the slurry proceeds down the screen and is dried into a paper sheet. While the GPA and APAE resins are preferably added in the form of a mixed resin solution, it is possible to add them individually.

Figure 2:
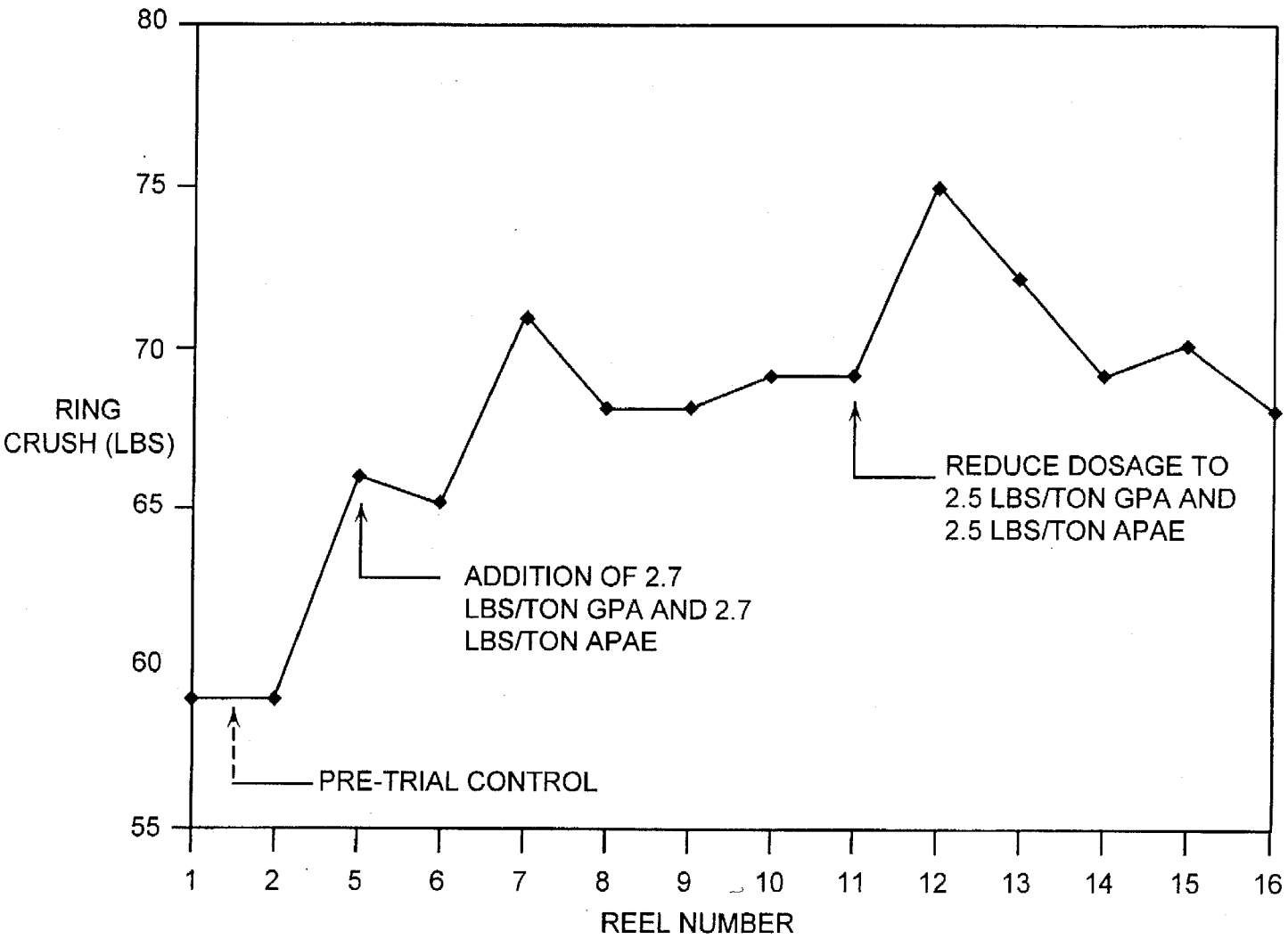
FIG. 2 is a graph showing the ring crush strength obtained with GPA/APAE resin solutions of this invention at various dosage rates.

This invention imparts dry strength to recycled paper, as measured by one or more of the paper's dry tensile strength, Mullen Burst, ring crush, Z-directional tensile strength, and Concora. FIG. 1 is a graph of the tensile strengths obtained with resin solutions having GPA:APAE weight ratios of 1:1, 2.5:1, and 5:1. FIG. 2 is a graph of ring crush obtained with GPA/APAE resin solutions at varying dosage rates. The resin solution is rapidly and substantially absorbed by fibers in the pulp slurry at pH values within the range from 3.5 to 8, and the use of retention aids is generally not necessary. The plateau range (the range over which amounts of the resin solution are added to an aqueous suspension of cellulose paper-making fibers at a given pH produces a negligible variation in dry strength) has not been ascertained for all fibers, but can readily be found by routine experimentation.

Figure 3:
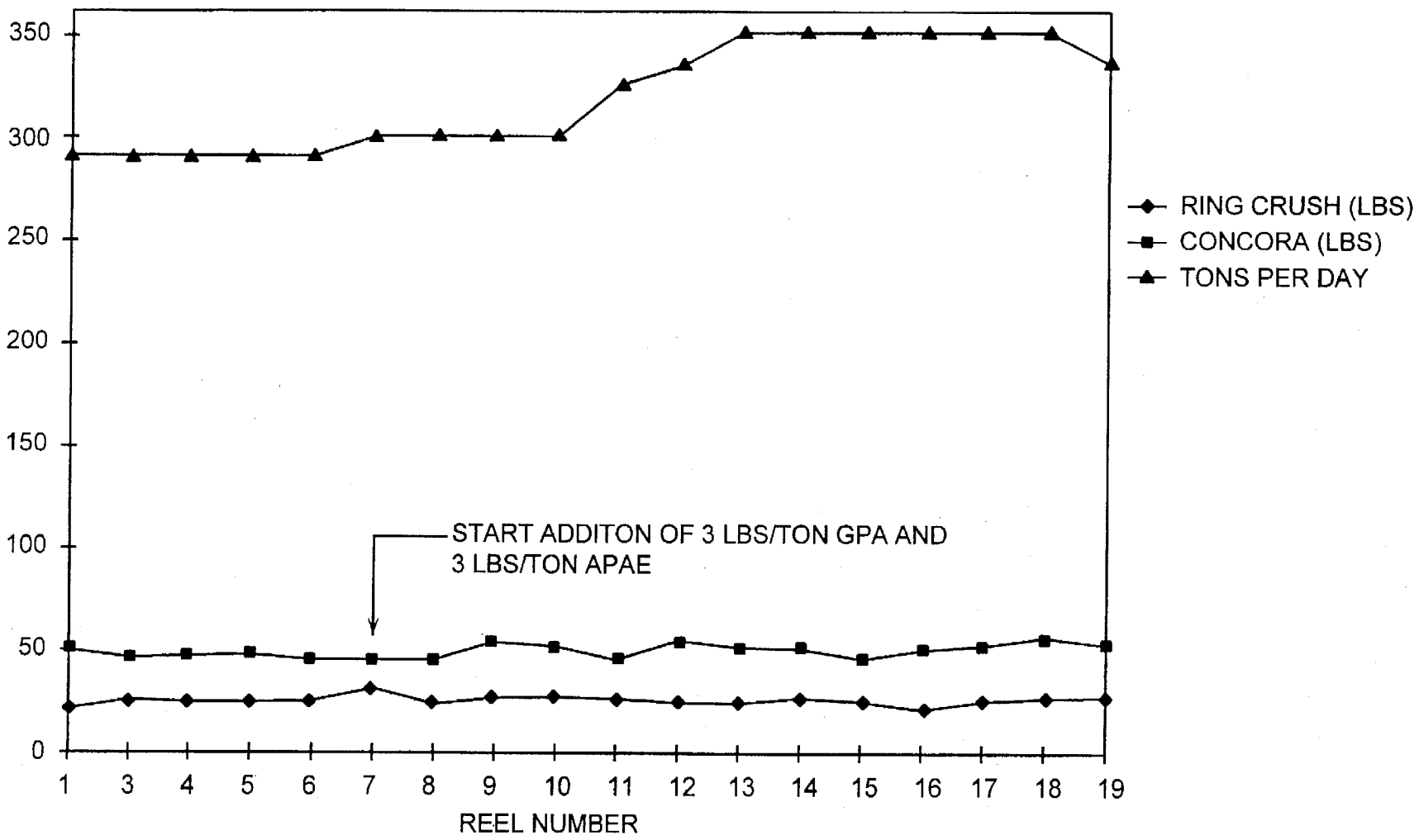
FIG. 3 is a graph showing machine output, ring crush strength and concora strength obtained by the addition of a mixed resin solution of this invention.

A particular benefit of this invention is that it allows an increase in machine speed and thus output while still producing paper of good dry strength. FIG. 3 is a graph of machine output (in tons per day) before and after addition of a mixed solution in accordance with this invention.

In the following non-limiting examples, all parts and percents are by weight unless otherwise specified.

EXAMPLE 1

To evaluate the present invention, three GPA:APAE resin solutions having weight ratios of 1:1, 2.5:1, and 5:1 respectively were prepared according to the following procedure.

A GPA resin solution (Discostrength® 19 having 8.0 wt % resin solids) was obtained from Callaway Chemical Co. An APAE resin solution (Discostrength® 5800 having 12.5 wt % resin solids) was obtained from Callaway Chemical Co. The APAE resin solution was placed in a mixing vessel equipped with a motor-driven stirrer and thermometer and the GPA resin solution added thereto at the desired weight ratio. The mixtures were stirred until uniform resin solutions were visually produced. The resulting mixed solutions each had initial viscosities of about 100 cp.

Each mixed resin solution was added to the wet end of a recycled paper machine at rates of 5 lbs and 10 lbs per ton of recycle pulp, and the dry tensile strengths of the resulting papers were measured by Instron Tensile Tester. For comparison purposes, the dry strengths of papers prepared with the GPA and APAE resins individually added to the pulp slurry was determined. The dry strength results are provided in Table 1.

TABLE 1

DRY STRENGTHS OF PAPERS PREPARED BY MIXED SOLUTION

| | DRY TENSILE STRENGTH, LB/IN$^2$ | | |
|---|---|---|---|
| DOSAGE (LBS/TONS) | 0 | 5 | 10 |
| GPA only | 16.4 | 16.6 | 18.6 |
| 1/1 (GPA:APAE) | 16.4 | 18.5 | 21.3 |
| 2.5/1 (GPA:APAE) | 16.4 | 18.9 | 22.6 |
| 5.0/1 (GPA:APAE) | 16.4 | 17.6 | 15.5 |
| APAE only | 16.4 | 19.4 | 21.2 |

Use of the GPA/APAE mixed resin solution having a 2.5:1 weight ratio imparted greater tensile strength to the paper than did the GPA/APAE resin solutions having weight ratios of 1:1 and a 5:1 at both dosage rates. Moreover, the 2.5:1 GPA/APAE resin solution imparted greater dry strength to paper prepared with the GPA resin alone at both dosages and with the APAE resin alone at a dosage rate of 10 pounds/ton.

Figure 4:
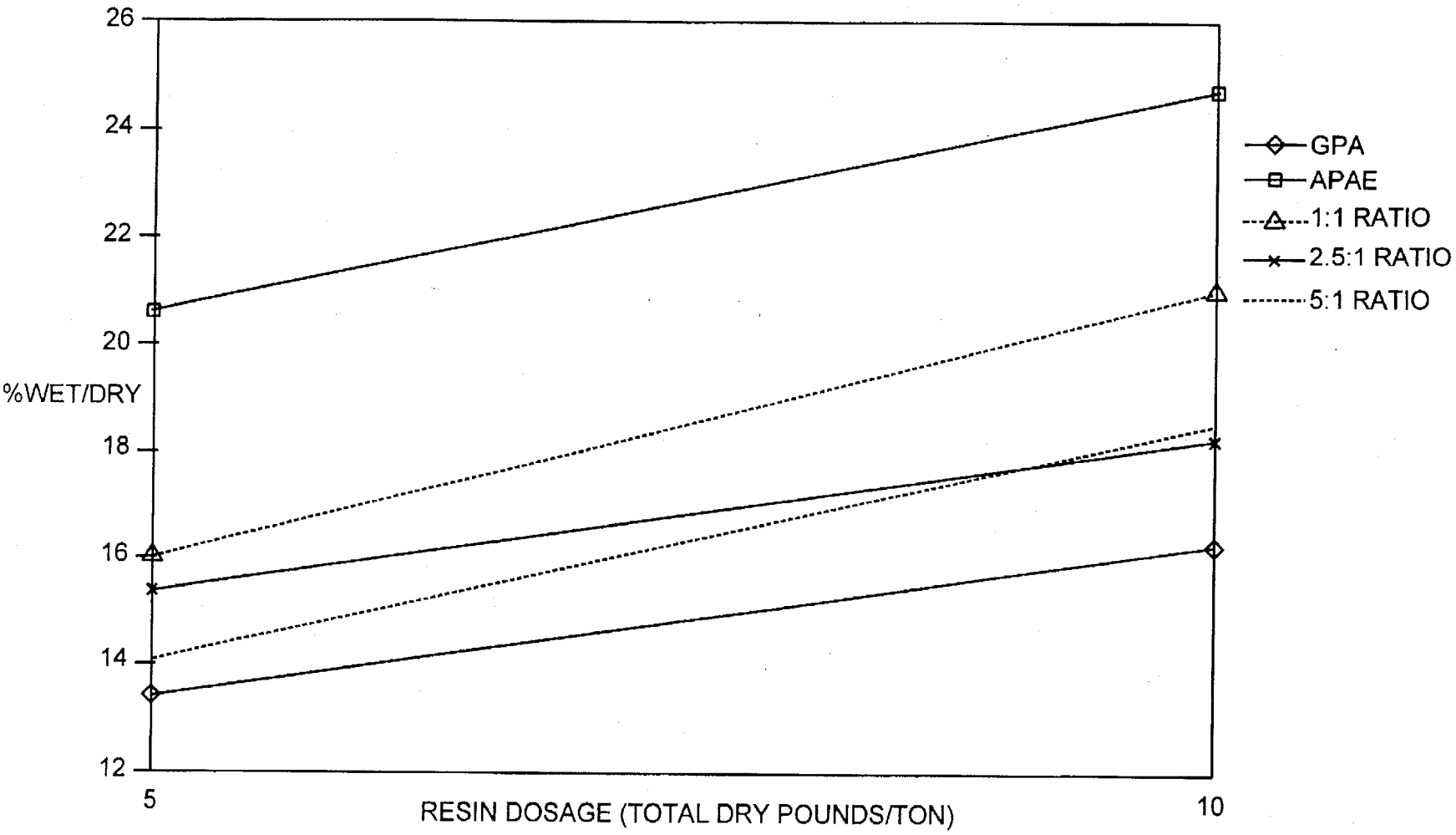
FIG. 4 is a graph showing the wet strength development of a recycled pulp slurry with GPA and APAE in various ratios.

While the recycle paper treated with only the APAE resin exhibited a greater dry tensile strength than the paper prepared with the mixed GPA/APAE resin solutions at a dosage rate of 5 lbs/ton, the APAE paper also exhibited an unacceptably increased wet tensile strength. FIG. 4 is a graph showing the wet strength development with GPA and APAE in different ratios.

EXAMPLE 2

In this Example, the procedures of Example 1 were repeated except that the GPA and APAE resins were added separately to the wet end of a recycle paper machine at varying amounts. Table 2 shows the effect of adding the GPA and APAE resin solutions by means of separate solutions and at weight ratios of 1:1, 2.5:1 and 5:1.

TABLE 2

DRY STRENGTHS OF PAPERS PREPARED BY SEPARATE SOLUTIONS

| | DRY TENSILE STRENGTH LB/IN$^2$ | | |
|---|---|---|---|
| DOSAGE (LBS/TONS) | 0 | 5 | 10 |
| GPA only | 16.4 | 16.6 | 18.6 |
| 1:1 (GPA:APAE) | 16.4 | 18.4 | 19.7 |
| 2.5:1 (GPA:APAE) | 16.4 | 16.7 | 19.7 |
| 5:1 (GPA:APAE) | 16.4 | 18.2 | 16.1 |
| APAE only | 16.4 | 19.4 | 21.2 |

As can be seen the separate addition of APEA and GPA resins at weight ratios of 1:1 and 2.5:1 produced paper having a lower dry strength as compared to the corresponding papers of Example 1. The separate addition of the GPA and APAE resins at a weight ratio of 5:1 produced paper with a slightly enhanced dry strength.

EXAMPLE 3

The procedure of Example 1 is repeated except that all of the various resin solutions are prepared and then stored for 28 days at room temperature prior to use. Addition of the resin solutions to the wet end of a recycled paper machine according the procedure of Example 1 is attempted and the resulting papers evaluated for dry strength. The mixed resin solutions are easily added and the papers prepared therefrom exhibit similar dry strengths to those shown in Table 1. The GPA resin solution is gelled and papers prepared therefrom show no increase in dry strength.

EXAMPLE 4

The procedure of Example 1 was repeated. To evaluate the performance of the resin solution as dry strength additives and wet strength resins in handsheets, the following procedure was followed. A commercial unbleached furnish consisting of 70% southern softwood kraft and 15% OCC recycled fiber was furnished in a receptacle. The pulp was beaten to a Canadian Standard Freenes of 350 ml. The handsheet were made at a basis weight of 60 g/m$^2$. The resin solutions were added to the pulp slurry at rates of 5 and 10 pounds dry strength resin per ton of dry pulp. The handsheets were cured for one hour in a 105° C. forced air oven, and then conditioned overnight in a constant temperature/humidity room (25 C./50% relative humidity). The results of wet and dry tensile tests are summarized in Table 1, and the dry tensile results are shown graphically on FIG. 2.

TABLE 3

| SAMPLE | DOSAGE (lbs/ton) | DRY TENSILE (lbs/in) | WET TENSILE (lbs/in) | % WET/DRY |
|---|---|---|---|---|
| BLANK | n/a | 16.31 | 1.21 | 7.42 |
| GPA | 5 | 18.59 | 2.55 | 13.40 |
| | 10 | 19.58 | 3.42 | 17.47 |

TABLE 3-continued

| SAMPLE | DOSAGE (lbs/ton) | DRY TENSILE (lbs/in) | WET TENSILE (lbs/in) | % WET/DRY |
|---|---|---|---|---|
| 1:1 | 5 | 20.10 | 3.26 | 16.23 |
| | 10 | 21.95 | 4.72 | 21.51 |
| 2.5:1 | 5 | 18.68 | 2.90 | 15.54 |
| | 10 | 21.28 | 3.96 | 18.61 |
| 5:1 | 5 | 18.61 | 2.69 | 14.46 |
| | 10 | 21.90 | 3.50 | 15.99 |
| APAE | 5 | 19.94 | 4.24 | 21.28 |
| | 10 | 22.88 | 5.59 | 24.44 |

The results show that the resin solutions are effective and dry strength resins.

What is claimed is:

1. A method for imparting strength to a recyclable paper with permanent and temporary wet strength resins by (a) adding to a recycle pulp slurry during a paper-making process a mixed resin solution comprising (i) an aminopolyamide-epichlorohydrin resin and (ii) a glyoxylated acrylamide-diallyldimethyl ammonium chloride resin, respectively; wherein the resin solution is added to the wet end of a paper machine and wherein the aminopolyamide-epichlorohydrin resin and the glyoxylated acrylamide-diallyldimethyl ammonium chloride resin are present at a weight ratio of about 1:1 to about 5:1, and (b) imparting both dry strength and wet strength to paper, wherein the wet strength of the paper is not increased to such an extent that the paper cannot be recycled.

2. The method of claim 1, wherein the resin solution is added to the recycle pulp slurry in the amount of about 10 pounds per ton of the recycle pulp slurry.

3. The method of claim 1, wherein the aminopolyamide-epichlorohydrin resin and the glyoxylated acrylamide-diallyldimethyl ammonium chloride resin are present at a weight ratio of about 2:1 to about 4:1.

4. The method of claim 1, wherein the aminopolyamide-epichlorohydrin resin and the glyoxylated acrylamide-diallyldimethyl chloride resin are present at a weight ratio of about 2.2:2.8.

5. The method of claim 1, wherein the resin solution is prepared by mixing separate solutions of the aminopolyamide-epichlorohydrin resin and the glyoxylated acrylamide-diallyldimethyl ammonium chloride.

6. The method of claim 1, wherein the glyoxylated acrylamide-diallyldimethyl ammonium resin is prepared with an acrylamide copolymer and glyoxal at a mole ratio of about 1:1.

7. The method of claim 1, wherein the aminopolyamide-epichlorohydrin resin is prepared with an aminopolyamide and epichlorohydrin at a mole ratio of about 1:1.25.

8. The method of claim 1, wherein the resin solution contains from about 5 to about 25 wt % total resin.

9. A recyclable paper produced by the method of claim 1.

* * * * *